United States Patent [19]

Neumann

[11] 3,942,697

[45] Mar. 9, 1976

[54] HOT STRIP ROLLING APPARATUS

[76] Inventor: Klaus Neumann, Am Klosterhang 13, 667 St. Ingert, Saar, Germany

[22] Filed: July 31, 1974

[21] Appl. No.: 493,262

[30] Foreign Application Priority Data

Aug. 2, 1973 Germany ..... 2339072

[52] U.S. Cl. ..... 226/46; 226/179; 226/192

[51] Int. Cl.[2] ..... B65H 17/22

[58] Field of Search ..... 226/12, 19, 20, 46, 47, 226/179, 181, 192

[56] References Cited

UNITED STATES PATENTS

| | | | |
|---|---|---|---|
| 2,827,809 | 3/1958 | Beam | 226/19 X |
| 3,177,751 | 4/1965 | Vercauteren | 226/19 X |
| 3,317,101 | 5/1967 | Himrod | 226/19 |
| 3,559,859 | 2/1971 | McArthur | 226/19 |

*Primary Examiner*—Richard A. Schacher
*Attorney, Agent, or Firm*—John J. Dennemeyer

[57] ABSTRACT

In hot strip rolling apparatus a driving roll stand is located between a rolling stand for producing the hot strip and a strip take-up reel. The driving roll stand comprises a pair of rolls capable of axial floating movement during take-up of the strip on said reel. A control system provides that the pair of rolls are locked axially when the strip tension between the rolling stand and the pair of rolls ceases.

4 Claims, 2 Drawing Figures

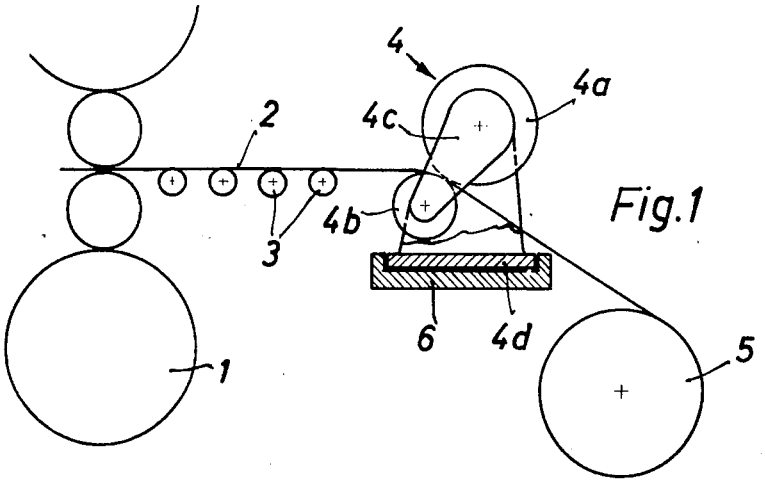
Fig.1
Fig.2
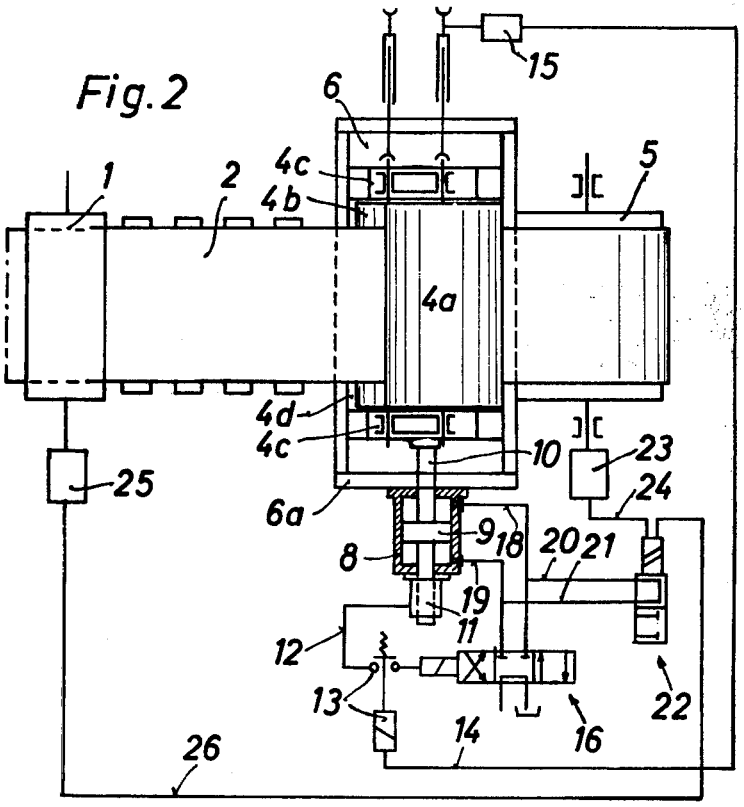

HOT STRIP ROLLING APPARATUS

The invention relates to an arrangement of a driving roll stand between a rolling mill for producing hot strip and a strip reel. Apart from sustaining the strip tension during the winding-up of the strip, it is the object of the driving roll stand to supply the hot strip leaving the stand to the strip reel, which is generally located in a lower position, whilst maintaining the tension between the rolling mill and driving roll stand, without the strip wandering sideways. After the beginning of the strip has been wound onto the strip reel by approximately one loop, the length of strip between the driving roll stand and strip reel comes under tensile stress.

Since the thickness of the hot strip is not always uniform, or even has an approximately wedge-shaped cross section under certain circumstances, the strip is not always correctly wound onto the strip reel. It was found that the driving roll stand exerts a considerable influence on the production of coils with correctly positioned loops, since it tensions the hot strip at a third point. If the strip has a somewhat wedge-shaped cross section for example, then the drive rollers acting with considerable pressure on the strip cause the strip to wander laterally. This has an immediate effect on the winding operation.

It is the object of the invention to produce correctly wound coils of hot strip, despite the fact that the strip is tensioned at three points during the winding operation, namely in the rolling mill, in the driving roll stand and in the strip reel. This object is fulfilled according to the invention in that the pair of driving rollers is free to move in axial direction out of a fixed initial axial position relative to the strip, at the same time that the strip is secured to the reel mandrel. This axial mobility of the pair of driving rollers from the time when the strip is clamped at three points, has the result that the pair of driving rollers is now able to wander laterally and the strip passes straight to the reel without a change of direction. The driving rollers may be axially movable in their bearings, but it is advisable for the driving roll stand to be movable as a whole in the axial direction of the driving rollers.

The control of the fixed initial axial position of the pair of driving rollers as well as the transition to free axial movement is undertaken according to the invention by a disengagable control device for selectively providing axial mobility and for fixing the pair of driving rollers in the initial axial position, which could be operated manually. However, in a further development of the invention, an automatic control of the adjusting device is proposed such that in the normal case, i.e. when it is unloaded, the pair of driving rollers is controlled in the fixed initial axial position, is free to move when there is strip tension between the driving rollers and reels and, when the strip tension between the rolling mill and driving roll frame ceases, is instantaneously stopped in its axial position until the strip leaves the driving rollers. The aforementioned stoppage of the driving rollers in the respective axial position, which they occupy when the hot strip leaves the last roll stand, ensures that the end of the strip is still guided at least in the driving roller frame, in order to wind this end of the strip in an orderly manner.

The details of an adjusting device and its automatic control are the object of Claim 4.

One embodiment of the arrangement according to the invention of a driving roll stand between a hot strip rolling mill and a strip reel is illustrated in the drawings.

FIG. 1 is a diagrammatic side view of the arrangement and

FIG. 2 is a plan view showing a hydraulic adjusting device and an automatic control.

The hot strip 2 leaving the last stand 1 of a wide strip rolling mill, passes over a roller bed with the roller bed rollers 3, only a very short portion of which is illustrated in FIG. 1, into a driving roll stand 4, whose shafts are located on an inclined plane, so that the strip 2 is deflected downwards to a strip reel 5 located at a lower position. Normally, the upper driving roller 4*a* has a significantly greater diameter than the lower driving roller 4*b*.

The driving rollers 4*a* and 4*b* are mounted in bearing housings 4*c*, which extend upwards from a common base plate 4*d*. The adjustability of the two driving rollers is not illustrated. According to the invention, the entire driving roll stand 4 is guided to move in axial direction, in that the base plate 4*d* is arranged to slide on a guide bed 6.

FIG. 2 shows a hydraulic servo motor 8, which is flange-connected to a raised wall 6*a* of the guide bed 6, as the servo motor for the control of the axial position of the driving roll stand 4 relative to the strip 2. Sliding in the hydraulic servo motor 8 is a double-acting piston 9, whose continuous piston rod 10 is firstly fixed to the adjacent bearing housing 4*c* of the driving roller stand 4 and secondly projects into a displacement pick-up 11, which monitors the position of the piston rod and thus of the driving roll stand on the guide bed 6. Serving for positioning and fixing the piston and thus a pair of driving rollers in the initial axial position is a first servo valve 16, which is connected by the pressure medium conduits 18, 19 to the two pressure chambers of the servo motor 8. In the illustrated switching position of the first servo valve 16, the piston 9 of the servo motor 8 is locked hydraulically, if the method of operations of a second servo valve 22 to be described hereafter, which is connected in parallel to the first servo valve 16 by way of the conduits 20, 21, is firstly disregarded.

For automatically positioning or restoring the pair of driving rollers, the displacement pick-up 11 sends signals by way of the signal lead 12 and a normally closed, electrically actuated isolating switch 13, in order to switch the first servo valve either towards the left or towards the right, until the initial axial position predetermined in the displacement pick-up 11 is provided and the first servo valve 16 assumes the blocking position illustrated. However, this servo valve must be locked in this blocking position when the strip 2 enters the driving roll stand 4 and the latter thus comes under load. A transmitter 15 is provided for this, which, when the pair of driving rollers is under load, sends a signal by way of the lead 14 for the electrical actuation of the isolating switch 13, in order to open the latter and interrupt the signal lead 12.

When the strip 2 is placed on the winding reel 5 and comes under tensile stress, a signal passes by way of a transmitter 23 and the lead 24 to the second servo valve 22. A further signal is sent by a transmitter 25 associated with the last roll stand 1 to the servo valve 22 by way of the lead 26, which signal indicates the loading of the roll stand. Only when both signals are present does the second servo valve 22 switch to the position illustrated, in which the two pressure medium conduits 18, 19 are short-circuited by the branch conduits 20, 21. Due to this, the piston 9 of the servo motor 8 and thus the driving roll stand 4 are free to move. As soon as the signal from the transmitter 25 ceases, i.e. the end of a strip leaves the roll stand 1, the second servo valve 22 instantaneously switches over to the blocking position, so that the driving rollers are stopped for guiding the end of the strip to the reel. On the other hand, if the beginning of a strip has already passed through the driving roll stand, but the reel tension is not yet effective, the second servo valve 22 remains in the locked position until the signal of the reel tension arrives from the transmitter 23.

The control device illustrated in FIG. 2 operates as follows: Due to spring pressure or the like, the electrically actuated isolating switch 13 is always closed during pauses in the rolling, so that the initial axial position of the driving roll stand is automatically provided by way of the displacement pick-up 11 and the first servo valve 16. The second servo valve 22 is in the change-over locked position, since neither the roll stand 1 nor the reel 5 are loaded. As soon as the beginning of a strip passes through the roll stand 1, the transmitter 25 sends a signal to the second servo valve 22, which is inactive. When the strip passes between the driving rollers of the driving roll stand 4, then the transmitter 15 sends a signal to the isolating switch 13, in order to open the latter and to block the first servo valve 16 in the locking position illustrated. After the beginning of the strip is engaged by the reel 5 and the reel tension begins, the transmitter 23 sends the necessary second signal for reversing the second servo valve 22 into the short-circuit position illustrated. The drive roller stand 4 is then free to move in axial direction over the entire travel of the strip. When a strip leaves the roll stand 1 and the signal from the transmitter 25 ceases, the second servo valve 22 returns to the locked position, the drive rollers thus being stopped in their instantaneous axial position. The isolating switch 13 remains open until the strip also leaves the driving roll stand 4 and the signal from transmitter 15 ceases. Since, at this instant, the signal lead 12 is once more closed, the cycle of positioning the driving roll stand in the initial axial position re-starts.

What is claimed is:

1. A hot strip rolling apparatus comprising a rolling stand for producing hot strip, a take-up reel located downstream of the rolling stand, a driving roll stand located intermediate said rolling stand and said take-up reel, said driving roll stand comprising a pair of axially movable rolls and a control means to lock said pair of rolls against axial movement when there is no strip tension between said rolling stand and said take-up reel, and to release said pair of rolls for free axial floating movement when there is strip tension between said rolling stand and said take-up reel.

2. Apparatus as claimed in claim 1, wherein said pair of rolls is movable as a unit.

3. Apparatus according to claim 1, wherein said control means operates automatically to move said pair of rolls into a fixed initial axial position when the rolls are unloaded, to release said rolls for free axial floating movement when strip tension occurs between said pair of rolls and said take-up reel, and to lock said rolls against axial movement when the strip tension ceases between said rolling stand and said pair of rolls.

4. A control system for a hot strip apparatus as claimed in claim 3, comprising a hydraulic servo-motor with a double-acting piston as the adjusting device, a first servo-valve for positioning and fixing the piston thus the pair of driving rollers in the initial axial position, a displacement pick-up for monitoring the piston position of the servo-motor, an electrically actuated isolating switch in the signal lead leading from the displacement pick-up to the first servo valve, a transmitter for supplying a signal when the pair of driving rollers is under load, which signal opens the isolating switch which is normally closed, a second servo valve parallel to the first servo valve for short-circuiting the pressure medium conduits between the servo motor and the first servo valve, due to which the piston of the servo motor and thus the pair of driving rollers is free to move in axial direction, and a transmitter indicating the presence of strip tension on the reel and a transmitter indicating the loading of the last roll stand, when the signals from both transmitters are present at the same time, the second servo valve changing-over from a locked position to short-circuit the pressure medium conduits and returning to the locked position when one of the two signals ceases.

* * * * *